US005127565A

United States Patent [19]

Grant

[11] Patent Number: 5,127,565

[45] Date of Patent: Jul. 7, 1992

[54] AMMUNITION DISPENSING GARMENT

[76] Inventor: Kieran P. Grant, 5608 Hilltop Rd., Fuquary Varina, N.C. 27526

[21] Appl. No.: 568,197

[22] Filed: Aug. 15, 1990

[51] Int. Cl.[5] ..... B65D 83/00; B65G 59/00

[52] U.S. Cl. ..... 224/196; 224/251; 224/252; 224/230; 221/310; 221/185; 2/94; 2/102; 2/250; 206/315.1

[58] Field of Search ..... 224/196, 223, 224, 239, 224/247, 248, 249, 251, 252, 230; 2/94, 102, 247, 250; 221/310, 309, 307, 185; 206/315.11

[56] References Cited

U.S. PATENT DOCUMENTS

| | | | |
|---|---|---|---|
| 160,432 | 3/1875 | Halabird et al. | 224/251 |
| 287,804 | 11/1883 | Collins | 224/196 |
| 466,298 | 12/1891 | Dean | 2/94 |
| 487,556 | 12/1892 | Dudley | 2/94 |
| 516,967 | 3/1894 | Dudley | 2/94 |
| 800,790 | 10/1905 | Boland | 2/94 |
| 995,086 | 6/1911 | Parrett | 221/310 |
| 1,212,513 | 1/1917 | Langerman | 2/94 |
| 1,612,705 | 12/1926 | Daniels | 221/185 |
| 2,864,541 | 12/1958 | Altick | 2/94 |
| 3,777,953 | 10/1991 | Lewis | 224/252 |
| 3,845,889 | 11/1974 | Hurd | 221/310 |
| 4,843,649 | 7/1989 | Jewell | 2/94 |

OTHER PUBLICATIONS

Exhibit A-Prior Art; no other information available.

*Primary Examiner*—Henry J. Recla
*Assistant Examiner*—Keith Kupferschmid
*Attorney, Agent, or Firm*—Rosenthal & Putterman

[57] ABSTRACT

A pocket for releasably holding a round of ammunition includes a substantially flat base sheet member and a dispensing tube forming sheet member of flexible material secured to the base sheet member and defining an ammunition dispensing tube for permitting ammunition to pass therethrough. The ammunition dispensing tube has an ammunition loading end and an ammunition dispensing end. A closable flap is connected to the base sheet member proximate the loading end of the ammunition dispensing tube. A retainer for releasably retaining the ammunition within the ammunition dispensing tube is operatively associated with the tube proximate its dispensing end. The pocket is adapted to be connected to a vest, jacket, stand, etc.

5 Claims, 3 Drawing Sheets

AMMUNITION DISPENSING GARMENT

FIELD OF THE INVENTION

This invention relates generally to the field of garments and accessories used in hunting, and more specifically for hunting vests that carry and dispense ammunition such as shotgun shells.

BACKGROUND OF THE INVENTION

The shotgun, commonly used in hunting waterfowl and other birds, by its very nature has only a limited ability to carry ammunition. For example, single barrel shotguns can carry only one shell, double barrel shotguns can carry two shells and pump action shotguns can carry and transfer to the barrel up to eight or nine shells before it becomes necessary to reload. Reloading must also be done quickly and it is, therefore, advantageous to have the shells readily available for this purpose.

In response to this need, a variety of shell dispensing garments have been produced. The majority of these garments take the form of a vest and include a plurality of vertically oriented cylindrical shell storage pouches. Located at the lower end of each of the pouches is a shell retaining structure. It is the shell retaining structure and the means by which it is connected to the pouch and/or vest and the mechanism for releasing the shell that usually varies from one vest to another. For example, U.S. Pat. No. 516,967 discloses a cartridge pouch having a discharge tube connected to the lower end of the shell pouch. The discharge tube is outwardly flared at its upper end and is placed within the pouch so that the material covers the flared portion. A metal band is then tightly fastened around the discharge tube with the material sandwiched therebetween. The lower or dispensing end of the tube includes a pair of inwardly covered discharge springs secured on opposite sides of the tube on the outside thereof by means of riveting or solder. Thus, when the chamber is filled with cartridges, primer down, the cartridges rest upon one another, the lowermost resting partly below and outside of the mouth of the discharge tube, upon and between the spring-stop, the springs being of such tenacity that this weight of the cartridge will not spread or open them to permit the cartridge to escape. To withdraw the cartridge it is grasped between the fingers or between the thumb and finger and drawn out between the springs, the springs closing to prevent escape of the succeeding cartridge. One notable deficiency of this vest resides in the placement of the cartridges primer down as this could allow for the accidental discharge of the shell upon contact with objects commonly encountered in the field such as rocks, metal portions of clothing and the like.

U.S. Pat. No. 487,556 to Dudley discloses another cartridge pouch. In this case the discharge tube includes a horizontal spring stop located near its bottom end. The inner curved end of the stop projects through the slot and intercepts the shell and prevents its usage. To discharge a shell, the outer end of the spring stop is pressed inwardly towards the tube, causing the inner end to move from a position blocking the passage of the shell to a second position which permits the shell to pass.

U.S. Pat. No. 466,428 to Dean discloses another magazine holder for cartridges wherein the cartridge discharge tube comprises a metallic tube that is attached to the garment using a wire encircling the tube and the garment end is drawn tightly around the same by twisting the ends of the wire at the rear of the garment. In order to further secure the discharge tube to the garment, the pouch may be slightly tapered to snugly encircle the tube. In one embodiment the discharge tube is tapered towards its lower end and is slotted to permit resilient action at that location. The shells are dropped into the pouch with the rim facing up and wherein a portion of the shell body extends out beyond the tube. To remove a shell it is grasped and pulled down, causing the tapered sides of the tube to spread, releasing the cartridge. The sides of the tube then spring back into position to similarly support the next shell. Additional embodiments of this concept are shown wherein different types of flat springs that are riveted to the tube are employed to attain the required spring action. As previously mentioned, the tube is connected to the pouch with a wire. This is less than optimal as with time, the fabric will become fatigued and will wear out at the point of connection therebetween.

Another shell dispensing hunting garment is found in U.S. Pat. No. 4,343,649 to Jewell et al. The garment includes a generally rectangular base or back sheet member that attaches to the vest. A second sheet member is formed into upright loops and is attached to the base with rows of stitching that extend along the sides and the loops.

A shell dispenser is mounted in the lower portion of each loop passage of each loop to retain the shells in the loop passage and allow the shells to be selectively removed from the dispenser. The dispenser comprises a tubular member that is releasably mounted on the back member. The tubular member has a tube passage aligned with the loop passage for accommodating shells. The tubular member has a lower end that includes a shell holder, such as one or more flexible downwardly extended fingers or a lip that retains the shells in the tube passage. Each finger has an inwardly directed stop member that engages the end of the lower shell to retain the shell in the tube passage. The finger is manually flexed in an outward direction to selectively remove the shell. In one form of the invention, a clip hook joined to the tube is used to releasably mount the tube in the passage. This vest, too, has its inherent drawbacks. First, the shell is held within the tube in a brass-down configuration. This is potentially dangerous as primer could easily be struck by a rock or other object which could cause accidental discharge of the shell. Second, the tube is attached to the garment using a hook having only a single point of attachment which, in the long term will induce excessive fatigue in the button hole of the garment which results in the tube being ripped out of place. Lastly, the brass of the shell protrudes only a short distance out beyond the bottom of the tube. As a result, the shell becomes difficult to gasp and is, therefore, hard to remove from the tube when reloading.

With the foregoing in mind, it is an object of the invention to provide an ammunition dispensing garment in which is safe as the brass portion of the ammunition remains within the discharge tube until removed therefrom.

Another object of the invention is to provide an ammunition dispensing garment wherein the shells are easily removable from the discharge tube.

Yet another object of the present invention is to provide an ammunition dispensing garment having an extended life wherein the discharge tube mounted to minimize and distributes the force generated when ammunition is pulled therefrom.

Still another object of the invention is to provide an ammunition dispensing garment that minimizes fatigue to the garment where the discharge tube is connected thereto.

SUMMARY OF THE INVENTION

In accordance with the present invention there is provided a retainer for releasably holding a round of ammunition. The retainer includes an annulus and a plurality of circularly arranged, spaced apart, resilient fingers, the fingers forming a cylindrical ammunition pathway and being connected at one of their ends to the annulus. An ammunition blocking means is included for impeding the free-flow of ammunition through the ammunition pathway positioned on at least one of the fingers. The retainer also includes a pair of outwardly extending wings, each of said wings having a proximal end and a distal end, and each of said proximal ends being tangentially connected to the annulus and extending outwardly in opposite directions therefrom and including a projection proximate the distal end thereof, the projection projecting downwardly in the direction of the fingers.

In another embodiment of the invention, the retainer includes a prongs means for insertingly connecting the retainer within a buttonhole. The prongs means comprises a projection connected to the annulus opposite the wing means and projecting downward in the direction of the fingers comprising a proximal shank portion and a terminating end portion that is wider than the shank portion. The terminating end portion may take the form of a downwardly pointing arrow head. In another embodiment, the prong means extends downward in the direction of the fingers at an angle toward the ammunition pathway or it may be angled inwardly and extend between a pair of adjacent fingers and have an inwardly angled or hooked terminating end portion.

BRIEF DESCRIPTION OF THE DRAWINGS

Additional objects and features of this invention will become apparent from the following detailed description and examples of illustrative embodiments of the invention, and from the accompanying drawings, in which.

DETAILED DESCRIPTION OF THE PREFERRED EMBODIMENTS

Figure 1:
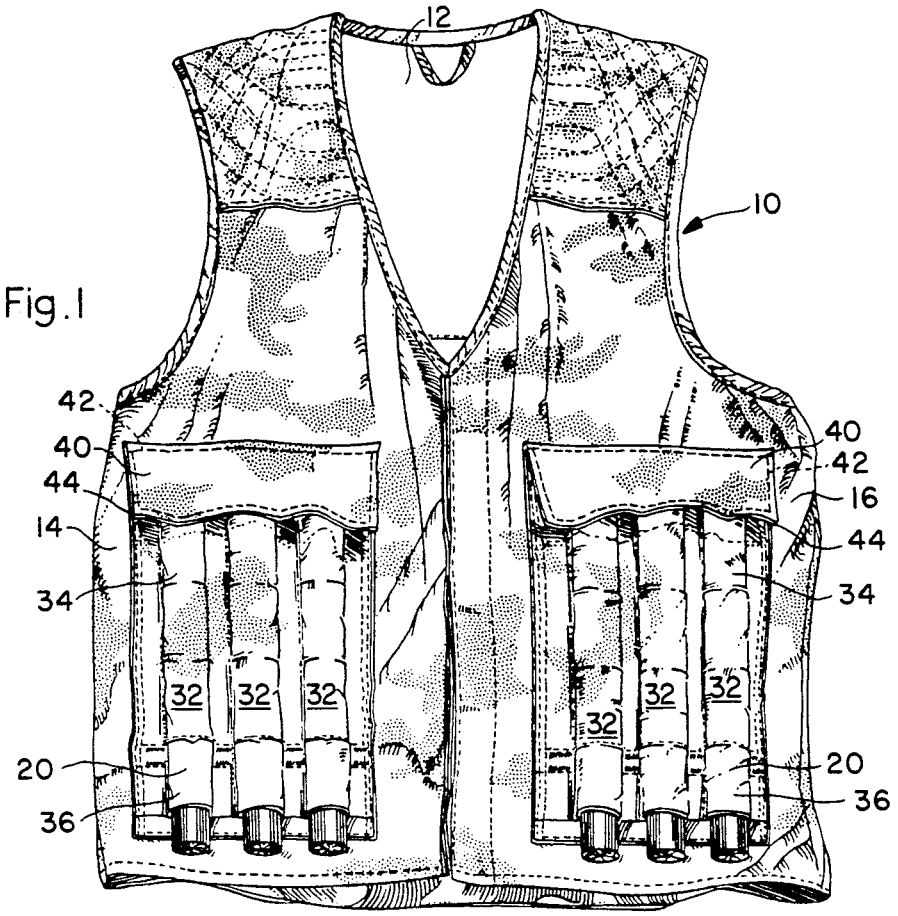
FIG. 1 is a front view of a vest incorporating the ammunition dispensing system of the present invention.
Figure 2:
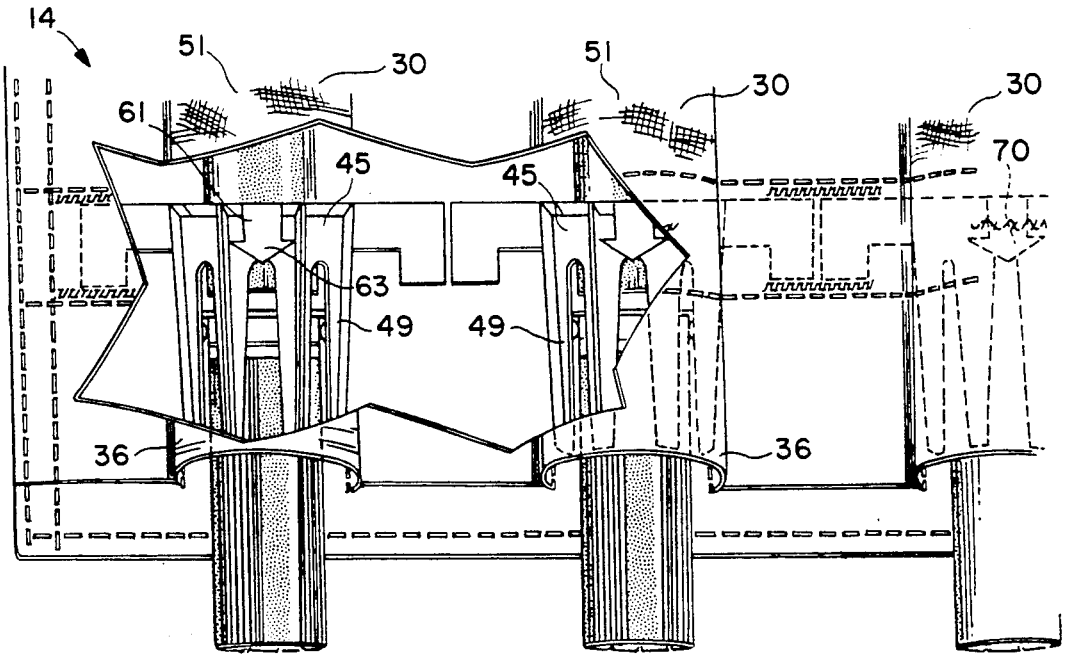
FIG. 2 is a detailed view partially broken away showing the retainer connected to the ammunition holding and dispensing pocket.

While the present invention will be described more fully with reference to the accompanying drawings, in which particular embodiments are shown, it is to be understood at this outset that persons skilled in the art may modify the invention while still achieving the favorable results of the invention. Accordingly, the description which follows is to be understood as a broad teaching disclosure directed to persons of skill in the appropriate arts and not as limiting upon the present invention.

Referring more particularly to the drawings, an ammunition dispensing garment, in the form of a vest is generally indicated at 10. The vest 10 is adapted to cover the upper torso and shoulders of the wearer.

The vest 10 includes a back panel 12 to which a game pouch may be connected (not shown) and side-by-side front panels 14,16 which may be connected together by means of a zipper, buttons, snaps, hook and loop fasteners or equivalents thereof.

An ammunition holding and dispensing pocket 20 is adapted to be connected to the central portion of each front panel. The ammunition holding and dispensing pocket may be permanently fastened to the front panel by stitching and the like, it may also be detachably mounted with hook and loop fasteners such as for example, Velcro. The ammunition holding and dispensing pocket is shown in the figures in combination with a hunting vest, however, it will be understood that the foregoing could easily be attached to a jacket, sling, suspenders, hunting seat etc. without requiring substantial modification and while still achieving the essential objects of the invention. In addition, the pocket can be employed as a stand alone belt accessory with the addition of belt loops or Alice clips to the back portion of the base sheet member.

The ammunition holding and dispensing pocket 20 comprises a base sheet member 25, a dispensing tube forming sheet member 30, a tube closing means 40 and a retaining means 45.

As illustrated in FIGS. 1,2,5 and 8, the ammunition holding and dispensing pocket 20 includes a substantially flat base sheet member 25 which is cut in a generally rectangular shape. The base sheet number 25 may be constructed of light weight nylon, polyester, duck canvas, etc. A dispensing tube forming member 30 of flexible material is secured by stitching or fusion (or equivalents thereof) to the base sheet member 25 and forms a plurality of elongate ammunition dispensing tubes or loops 32. Each of the ammunition dispensing tubes 32 include an ammunition loading end 34 and an ammunition dispensing end 36. Each of the tubes define passageways of sufficient diameter and length to accommodate a plurality of shells such as 10 guage or 12 gauge shotgun shells in end to end abutting relation. In addition, the tubes are of sufficient diameter to permit the shells to slide freely through the tube.

A tube closing means 40 in the form of a horizontally mounted flap or cover is provided. The top edge 42 of the flap 40 is attached by suitable means to the base sheet member and the bottom edge 44 overlies and releasably closes the ammunition loading ends 34 of the ammunition dispensing loops 32. Releasable fasteners, such as hook and loop fasteners, buttons, snaps, and hooks (not shown) are positioned o the underside of the flap 40 and on the corresponding underlying surface of the ammunition dispensing tubes 32. The flaps 40 can be folded-up to facilitate loading of ammunition into the tubes.

A retaining means or retainer 45 for releasably retaining the ammunition is operatively associated with each of the tubes proximate each of their dispensing ends 36.

Figure 3:
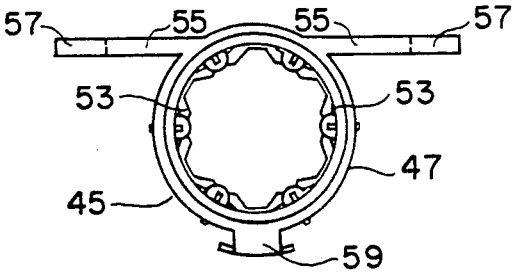
FIG. 3 is a plan view of a first embodiment of the retainer according to the present invention.
Figure 4:
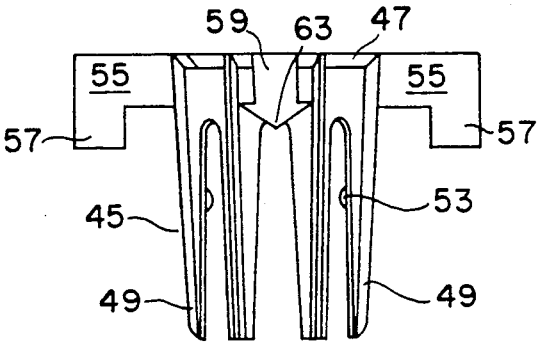
FIG. 4 is a front view of a first embodiment of the retainer according to the present invention.
Figure 5:
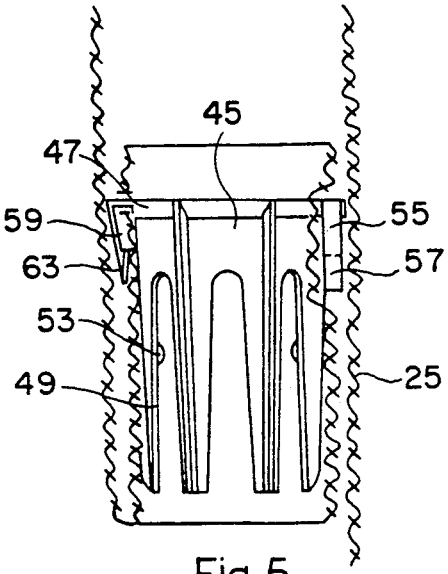
FIG. 5 is a side view of a first embodiment of the retainer according to the present invention and illustrating it sewn into an ammunition holding and dispensing pocket.

The retainer includes an annulus or ring 47 and a plurality of circularly arranged, spaced apart, resilient fingers 49 that form a cylindrical ammunition pathway 51. The fingers 49 are connected at one of their ends to the annulus 47. At least one of the fingers 49 includes an ammunition blocking means for impeding the free flow of ammunition through the ammunition pathway. As shown in FIGS. 3 through 5, each of the fingers 49 includes a protuberance 53 which serves to impede the free flow of ammunition through the ammunition pathway. The retainer 45 also includes a pair of outwardly extending wing means or wings 55. Each of the wings has a proximal end and a distal end, the proximal ends being tangentially connected to the annulus 47 and extending outwardly in opposite directions therefrom. Each of the wings 55 also include a projection 57 located proximate the distal end thereof, the projection 57 projecting downwardly in the direction of the fingers 49.

The retainer may also include a prong means or prong 59 for insertingly connecting the retainer 45 within a buttonhole. The prong 59 is connected to the annulus 47 opposite the wings 55 and projects downward in the direction of fingers 49. The prong 59 includes a proximal shank portion 61 and a terminating end portion 63. In one embodiment of the invention as shown in FIGS. 3 through 5, the gripping means or terminating end portion 63 is generally in the shape of a downwardly pointing arrow head. In another embodiment of the invention shown in FIGS. 6 through 8, the prong 59 is connected to annulus 47 and extends downward in the direction of the fingers at an angle towards the ammunition pathway. As shown, the prong is angled inwardly and extends between a pair of adjacent fingers 49 and includes an inwardly angled terminating end portion.

Figure 6:
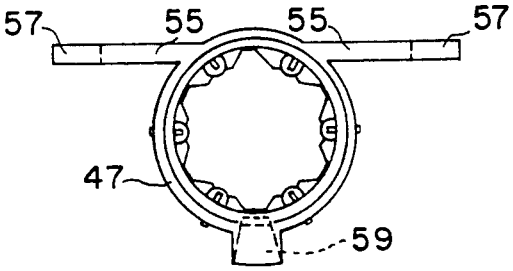
FIG. 6 is a plan view of a second embodiment of the retainer according to the present invention.
Figure 7:
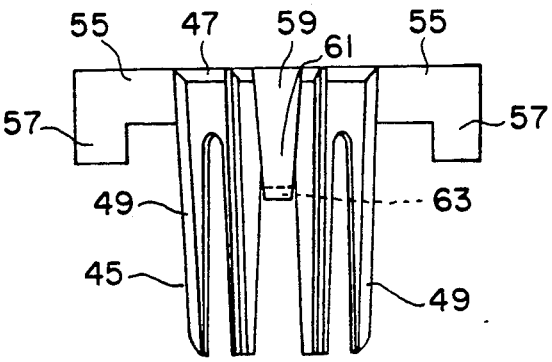
FIG. 7 is a front view of a second embodiment of the retainer according to the present invention.
Figure 8:
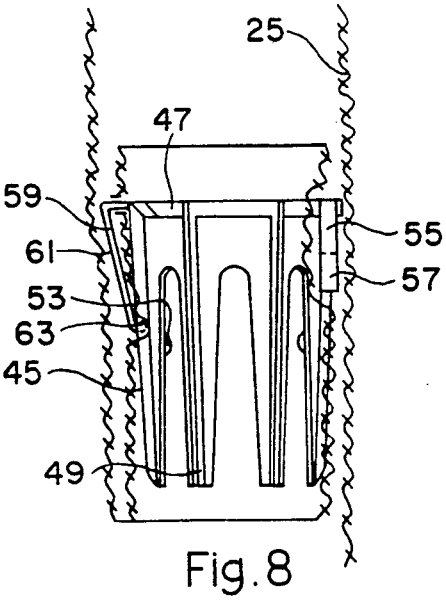
FIG. 8 is side view of a second embodiment of the retainer according to the present invention and illustrating it sewn into an ammunition holding and dispensing pocket.

The retaining means 45 (illustrated in FIGS. 3 through 8) is connected to the ammunition dispensing end of the ammunition dispensing tube at three separate points. First, each of the wings 55 is tacked with stitching between the base sheet member 25 and the dispensing tube forming sheet member 30. In addition, the dispensing tube forming member includes a buttonhole 70 that is adapted to receive the terminating end portion 63 of the prong 59. It is important to note that the distal ends of adjacent wings 55 lie in substantial abutting relation. Also, the terminating end portion 63 of the prong 59 is designed to fit within buttonhole 70 and to remain therein. For example, the buttonhole 70 is sized to deflect outwardly and away when receiving the arrow head shaped terminating end portion 63 and to close back down when insertion has been completed. Thus, as with a conventional arrow head, insertion is accomplished with relatively little effort, however, removal of the same is very difficult. Similarly, the embodiment illustrated in FIGS. 6 through 8 is designed to be received within the buttonhole 70 and to grab and hold the fabric within adjacent FIGS. 49. It will be noted that adjacent wings 55 are in substantial abutting relation and that the securement means is tightly held within the buttonhole 70. This is done specifically to extend the life of the garment under conditions of extended use as the inventor has learned that movement of the retaining means 45 invariably leads to fabric fatigue and eventual failure.

Figure 9:
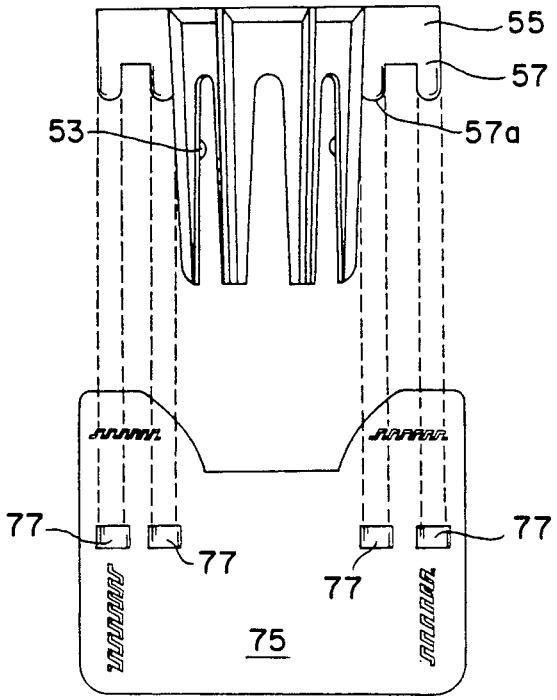
FIG. 9 is an exploded front view of a third embodiment of the retainer according to the present invention.
Figure 10:
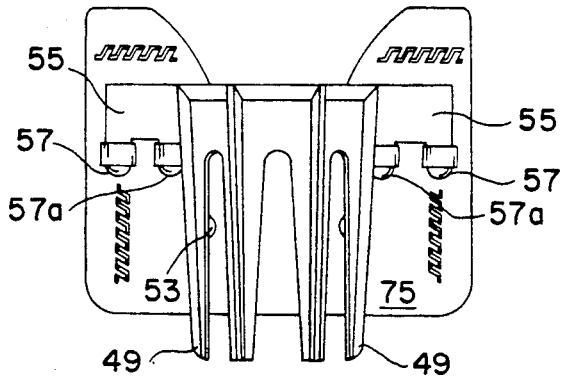
FIG. 10 is a front view of a third embodiment of the retainer according to the present invention.
Figure 11:
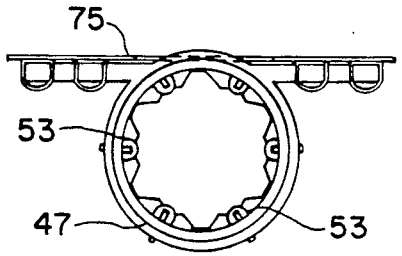
FIG. 11 is a plan view of a third embodiment of the retainer according to the present invention.

Another embodiment of the invention is shown in FIGS. 9 through 11 wherein the retaining mean 45 is substantially similar to those previously described. Therefore, structures which are similar will bear the same identifying numbers in the discussion which follows. The retaining means 45 includes an annulus 47 and a plurality of circularly arranged, spaced apart, resilient fingers 49 forming a cylindrical ammunition pathway 51, the fingers being connected at one of their ends to the annulus. Each finger 49 includes an ammunition blocking means or protuberance 53 that impedes the free flow of ammunition through the ammunition pathway. A pair of outwardly extending wing means or wings 55, each having a proximal end and a distal end are tangentially connected to the annulus and extend outwardly in opposite directions therefrom. Each wing includes a projection 57 and a medially located projection **57*a*** which are directed downwardly in the direction of the fingers.

In addition, a flat, substantially rectangular, mounting member 75, adapted to be pierced by a sewing machine needle and including two pairs of spaced mounting loops 77, each of the loops being adapted to slidably receive a respective one of the projections 57, **57*a*** and sonically welded in place.

During assembly of the pocket 20, the retainer projections 57, **57*a* are mounted within the mounting loops 77 of mounting member 75. The completed retainer structure 45 is then placed on base sheet member 25 and is sewn thereto as indicated by the stitching S in FIGS. 9 and 10. The dispensing tube forming member is then sewn to the base sheet member 25 to form the ammunition dispensing tubes 32 in the same manner as the pocket shown in FIGS. 1 and 2. It will be noted that in the embodiment just described, the securement means is not required in order to maintain the retaining means 45 in position within the ammunition dispensing tube as sufficient structural support is provided by mounting member 75**.

The retainer described herein may be fabricated by molding techniques using polyethelyene, acetal, polyacetal or polypropelene using methods well known to those skilled in the art.

Any of the foregoing ammunition dispensing pockets may then be connected as earlier described to a hunting vest, jacket and the like.

In operation, the flap 40 is opened, the shells are inserted into each loop 32 with brass end facing up and the flap 40 is then closed. The shells then lie in an end-to-end relation in each loop 32. The protuberances on the fingers prevent the free passage of the bass portion of the lowermost shell through the loop 32 and as a result, the body portion protrudes out from the pocket 20 as shown in FIG. 1. When it is desired to withdraw the lowermost shell from the loop, the user simply grips the body protion of the shell and pulls down, this causes the fingers 49 to spread, permitting the brass to pass by the protuberances 53. The fingers 49 then spring back into the original positon and the next shell is gravity fed into position as the lowermost shell ready for removal.

The foregoing embodiments and examples are to be considered illustrative, rather than restrictive of the invention, and those modifications which come within the meaning and range of equivalence of the claims are to be included therein.

That which is claimed is:

1. A retainer for releasably holding a round of ammunition comprising:

(a) an annulus, a plurality of circularly arranged spaced apart resilient fingers, said fingers forming a cylindrical ammunition pathway, said fingers being connected at one of their ends to said annulus, a protuberance impeding the free flow of ammunition through said ammunition pathway positioned on at least one of said fingers, and a pair of outwardly extending wing means, each having a proximal end and a distal end, each of said proximal ends being tangentially connected to said annulus and extending outwardly in opposite directions therefrom and including a projection proximate the distal end thereof, said projection projecting downwardly in the direction of said fingers;

(b) a flat substantially rectangular mounting member adapted to be pierced by a sewing machine needle and including a pair of spaced apart mounting loops, each of said mounting loops being adapted to slidably receive a respective one of said projections.

2. An ammunition holding and dispensing pocket adapted to be connected to a vest, jacket, sling and the like comprising:

a substantially flat base sheet member;

a dispensing tube forming sheet member of flexible material secured to said base sheet member and defining an ammunition dispensing tube for permitting ammunition to pass therethrough having an ammunition loading end and an ammunition dispensing end, a tube closing means connected to said base sheet member proximate the ammunition loading end of said ammunition dispensing tube;

a retaining means for releasably retaining ammunition operatively associated with said tube proximate the ammunition dispensing end thereof, said retaining means comprising:

(a) an annulus, a plurality of circularly arranged spaced apart resilient fingers, said fingers forming a cylindrical ammunition pathway, said fingers being connected at one of their ends to said annulus, a protuberance impeding the free flow of ammunition through said ammunition pathway positioned on at least one of said fingers, and a pair of outwardly extending wing means having a proximal end and a distal end, each of said proximal ends being tangentially connected to said annulus and extending outwardly in opposite directions therefrom and including a projection proximate the distal end thereof, said projection projecting downwardly in the direction of said fingers, and (b) a substantially flat rectangular mounting member adapted to be pierced by a sewing machine needle and including a pair of spaced apart mounting loops, each of said mounting loops being adapted to slidably receive a respective one of said projections.

3. A retainer according to claim 2 wherein each of said fingers includes an ammunition blocking protuberance.

4. A retainer according to claim 2 further including:

(a) an intermediate downwardly directed projection on each of said wing means positioned between the respective proximal and distal ends, and (b) a second pair of mounting loops connected to said mounting member and being adapted to slidably receive a respective one of said intermediate projections.

5. A retainer according to claim 2 wherein said mounting loops are integrally formed with said mounting member.

* * * * *